US010065292B2

(12) United States Patent
Chern

(10) Patent No.: US 10,065,292 B2
(45) Date of Patent: Sep. 4, 2018

(54) RATCHET WRENCH WITH PLANET GEAR UNIT

(71) Applicant: Shwu-Ruu Chern, Taichung (TW)

(72) Inventor: Shwu-Ruu Chern, Taichung (TW)

( * ) Notice: Subject to any disclaimer, the term of this patent is extended or adjusted under 35 U.S.C. 154(b) by 352 days.

(21) Appl. No.: 15/071,174

(22) Filed: Mar. 15, 2016

(65) Prior Publication Data

US 2017/0266787 A1 Sep. 21, 2017

(51) Int. Cl.
*B25B 13/46* (2006.01)

(52) U.S. Cl.
CPC ..... *B25B 13/467* (2013.01); *B25B 13/463* (2013.01)

(58) Field of Classification Search
CPC ... B25B 13/463; B25B 13/467; B25B 13/465; B25B 17/00
USPC ..... 81/57.3, 57.22
See application file for complete search history.

(56) References Cited

U.S. PATENT DOCUMENTS 2,641,136 A * 6/1953 Marsden, Jr. ..... B25B 13/467 475/270
3,983,759 A * 10/1976 Linden ..... B25B 13/467 74/404
4,475,420 A * 10/1984 Atkinson ..... B25B 13/463 475/270
5,009,132 A * 4/1991 Gilberto ..... B25B 13/463 74/143
7,168,340 B1 * 1/2007 Green ..... B25B 13/465 81/57.3
7,536,934 B1 * 5/2009 Tatangelo ..... B25B 13/463 81/57.22
2002/0152847 A1 * 10/2002 Foard ..... B25B 13/467 81/57.29

* cited by examiner

*Primary Examiner* — Joseph J Hail
*Assistant Examiner* — Arman Milanian
(74) *Attorney, Agent, or Firm* — Pro-TECHTOR International Services; Ian Oglesby

(57) ABSTRACT

A ratchet wrench includes a center gear connected to the top of the ratchet wheel and a disk is mounted to the center gear. Three planet gears is connected to the disk and engaged with the center gear. A rotary member is rotatably mounted to the disk and has inner teeth engaged with the planet gears. Two pawls are respectively engaged with the disk and the ratchet wheel. A shank extends through the rotary member, the disk, the center gear and is connected to the ratchet wheel. When rotating the rotary member, the planet gears rotate the center at high speed, and the center gear rotates the ratchet wheel to quickly rotate the object to be tightened or loosened.

3 Claims, 9 Drawing Sheets

RATCHET WRENCH WITH PLANET GEAR UNIT

BACKGROUND OF THE INVENTION

1. Fields of the Invention

The present invention relates to a ratchet wrench, and more particularly, to a ratchet wrench with a planet gear unit to quickly rotate the ratchet wheel.

2. Descriptions of Related Art

The conventional way to tighten or loosen an object such as a bolt, is to use a wrench which has a polygonal hole and the object is engaged with the polygonal hole. The user rotates the ratchet wrench to rotate the object. However, when using the conventional wrench in a narrow space, the user has to dismount the wrench from the object, and then mount the object at another angle to allow the wrench to rotate in the narrow space. This restricts the efficiency of the use of the conventional wrench. A ratchet wrench is developed to improve the problem and the ratchet wrench can be rotated back and forth continuously without dismounting the ratchet wrench from the object. Nevertheless, a half of the rotational action of the ratchet wrench does not rotate the object.

The present invention intends to provide a ratchet wrench which includes a planet gear unit to quickly rotate the ratchet wheel to tighten or loosen the object within a short period of time without rotating the handle of the ratchet wrench.

SUMMARY OF THE INVENTION

The present invention relates to a ratchet wrench and comprises a handle and a head which is connected to one end of the handle. The head has a room defined therethrough so as to receive a ratchet wheel therein. The ratchet wheel has ratchet teeth defined in an outside thereof. A first engaging portion and a driving end are respectively formed on the top and the bottom of the ratchet wheel. A bead is embedded in the driving end.

A switch unit has two pawls, a switch shaft and a contact portion, wherein the two pawls and the switch shaft are received in the room. Each pawl has engaging teeth formed in the front side of two ends thereof. The engaging teeth on the two ends of one of the pawls are selectively and respectively engaged with the ratchet teeth of the ratchet wheel. The switch shaft is pivotably connected to the head. The contact portion is connected to the switch shaft, and contacts the two pawls.

A cover is connected to the head, and the driving end of the ratchet wheel extends through the cover. A center gear has a first hole defined in the top thereof. A second engaging portion extends from the bottom of the center gear and is engaged with the first engaging portion of the ratchet wheel. A disk has a toothed portion defined in the outside thereof and is connected to the top of the ratchet wheel. A second hole is defined centrally therethrough and the center gear is received in the second hole. Three recesses are defined in the top of the disk. The engaging teeth of the two ends of the other pawl are selectively and respectively engaged with the toothed portion.

A planet gear unit has three planet gears which are respectively located in the three recesses of the disk. The center gear is located between the three planet gears and engaged with the three planet gears. A rotary member has a third hole defined centrally therethrough. The rotary member has a recessed area defined in the bottom thereof and inner teeth are defined in the inner periphery of the recessed area. The rotary member is mounted to the three planet gears which are engaged with the inner teeth. A push member has a shank, and a notch is defined in an outside of the shank. The shank extends through the third hole of the rotary member, the first hole of the center gear and is inserted into the ratchet wheel. The bead of the driving end is accommodated in the notch of the shank.

Preferably, the contact portion includes two protrusions and two springs which respectively bias the two protrusions. The two protrusions respectively contact two respective rear sides of the two pawls.

Preferably, the second engaging portion of the center gear is a hexagonal protrusion. The first engaging portion of the ratchet wheel is a hexagonal recess.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
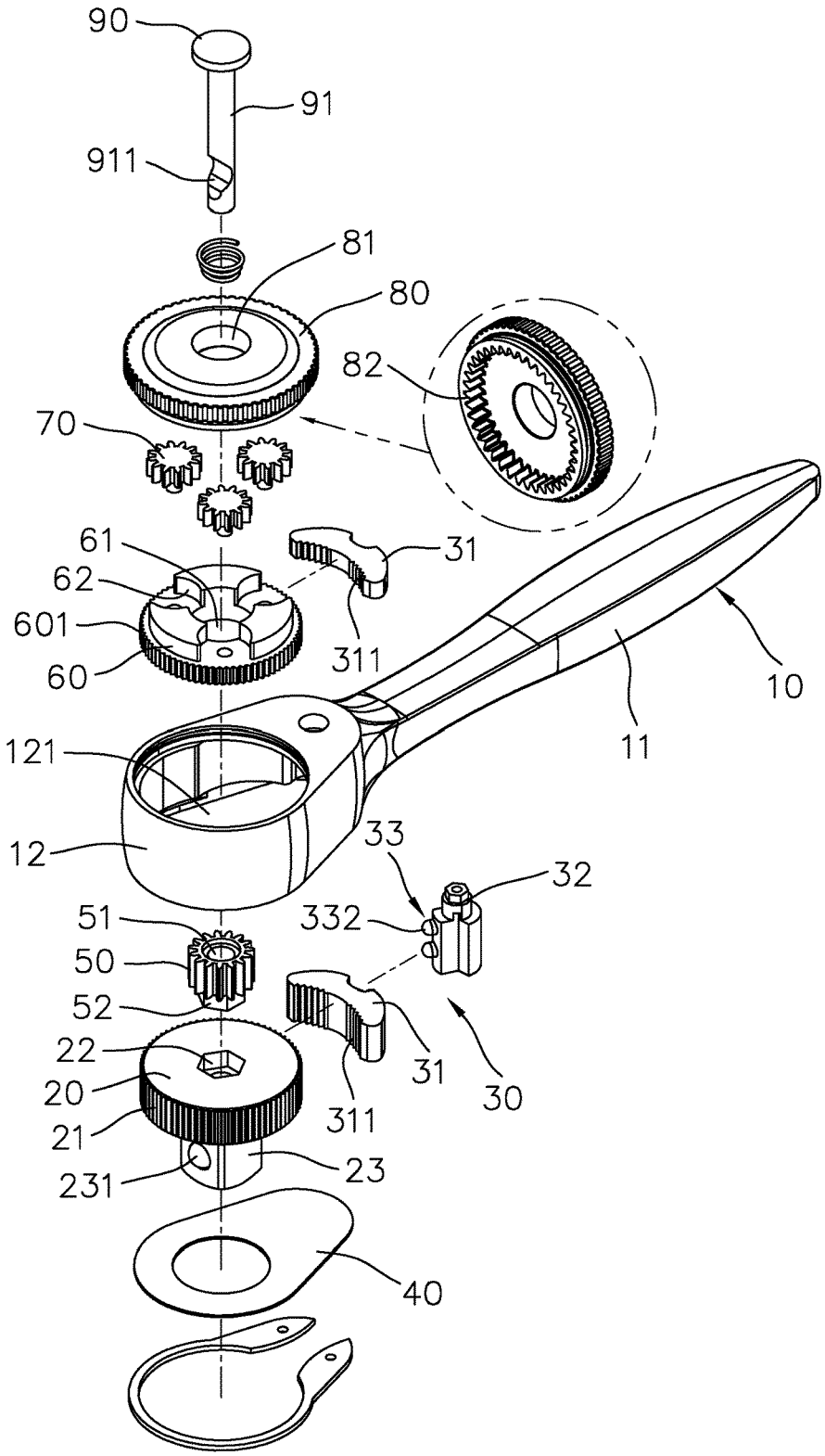
FIG. 1 is an exploded view of the ratchet wrench of the present invention.
Figure 2:
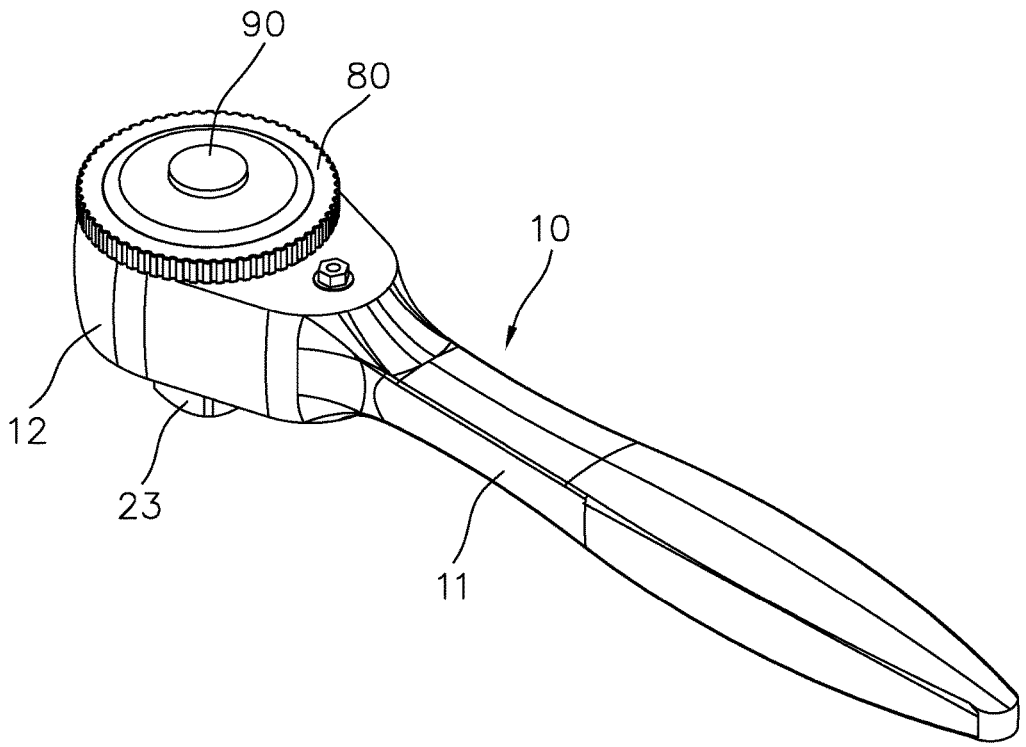
FIG. 2 is a perspective view to show the ratchet wrench of the present invention.
Figure 3:
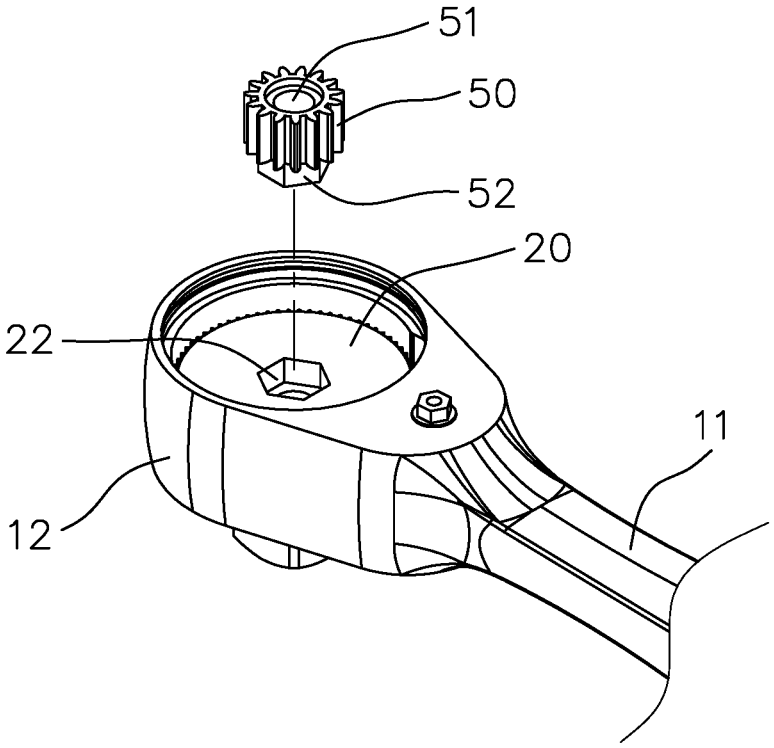
FIG. 3 is an exploded view to show the center gear to be installed to the ratchet wrench of the present invention.
Figure 4:
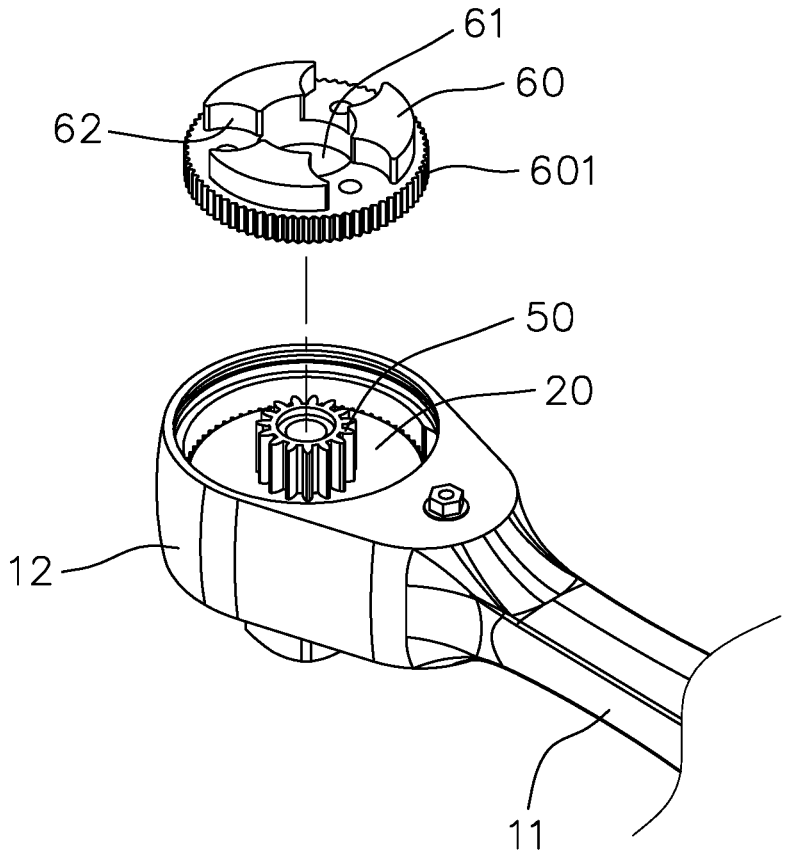
FIG. 4 is an exploded view to show the disk to be mounted to the center gear installed in the ratchet wrench of the present invention.
Figure 5:
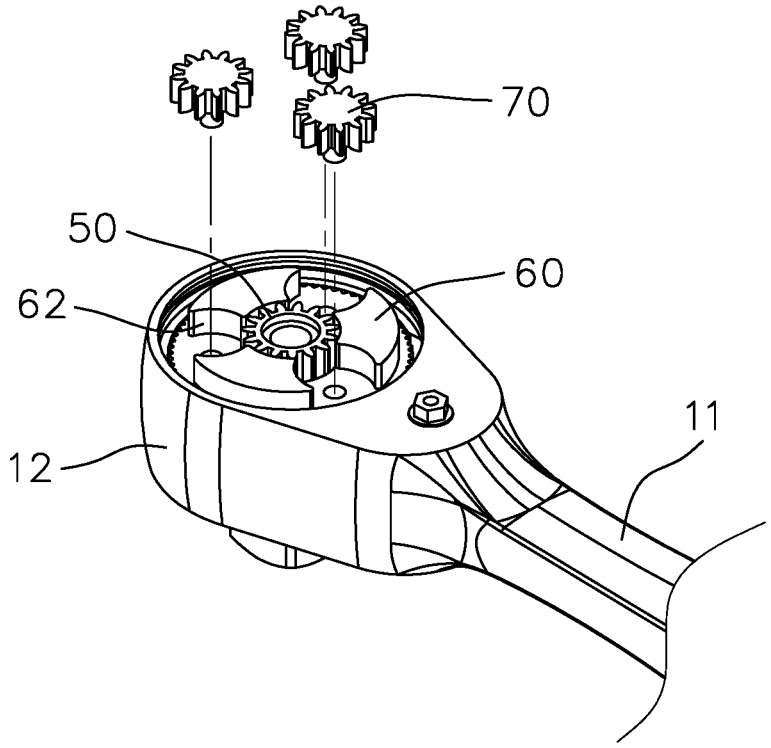
FIG. 5 is an exploded view to show the three planet gears to be connected to the disk installed in the ratchet wrench of the present invention.
Figure 6:
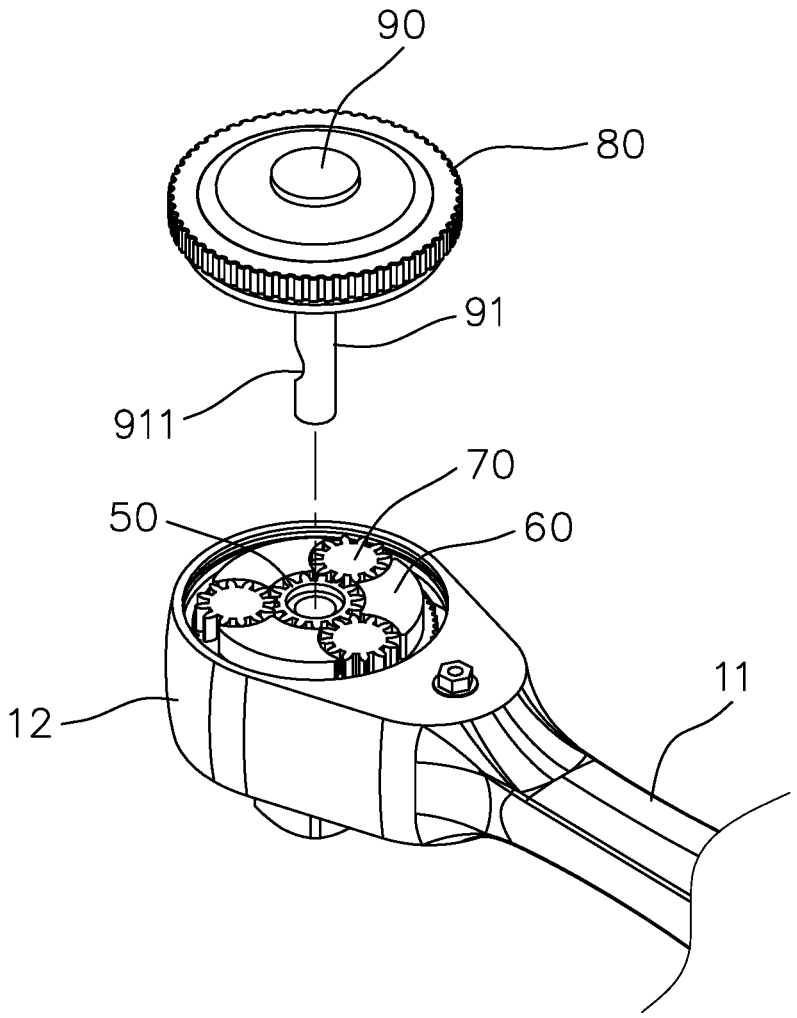
FIG. 6 is an exploded view to show the rotary member and the push member to be connected to the ratchet wrench of the present invention.

Referring to FIGS. 1 to 9 the ratchet wrench 10 of the present invention comprises a handle 11 and a head 12 which is connected to one end of the handle 11. The head 12 has a room 121 defined therethrough.

A ratchet wheel 20 is rotatably received in the room 121 and has ratchet teeth 21 defined in the outside thereof. A first engaging portion 22 is defined in the top of the ratchet wheel 20, in this embodiment, the first engaging portion 22 of the ratchet wheel 20 is a hexagonal recess. A driving end 23 extends from the bottom of the ratchet wheel 20, and a bead 231 is embedded in the driving end 23. In this embodiment, the driving end 23 is a rectangular rod for being connected with a socket for example.

A switch unit 30 has two pawls 31, a switch shaft 32 and a contact portion 33, wherein the two pawls 31 and the switch shaft 32 are received in another room defined in the inner periphery of the room 121. Each pawl 31 has engaging teeth 311 formed in the front side of two ends thereof. The engaging teeth 311 on the two ends of one of the pawls 31 are selectively and respectively engaged with the ratchet teeth 21 of the ratchet wheel 20. The switch shaft 32 is pivotably connected to the head 12, and the contact portion 33 is connected to the switch shaft 32. The contact portion 33 includes two protrusions 332 and two springs 331 which respectively bias the two protrusions 32. The two protrusions 332 respectively contact two respective rear sides of the two pawls 31.

A cover 40 is connected to the head 12, and the driving end 23 of the ratchet wheel 20 extends through a hole of the cover 40. A center gear 50 has a first hole 51 defined therethrough, and a second engaging portion 52 extends from the bottom of the center gear 50. In this embodiment, the second engaging portion 52 of the center gear 50 is a hexagonal protrusion. The second engaging portion 52 is engaged with the first engaging portion 22 of the ratchet wheel 20.

A disk 60 has a toothed portion 601 defined in the outside thereof and the disk 60 is connected to the top of the ratchet wheel 20. A second hole 61 is defined centrally therethrough and the center gear 50 is received in the second hole 61. Three recesses 62 are defined in the top of the disk 60. The engaging teeth 311 of the two ends of the other pawl 31 are selectively and respectively engaged with the toothed portion 601.

A planet gear unit has three planet gears 70 which are respectively located in the three recesses 62 of the disk 60. The center gear 50 is located between the three planet gears 70 and engaged with the three planet gears 70.

A rotary member 80 has a third hole 81 defined centrally therethrough. The rotary member 80 has a recessed area defined in the bottom thereof, and inner teeth 82 are defined in the inner periphery of the recessed area. The rotary member 80 is mounted to the three planet gears 70 which are engaged with the inner teeth 82.

A push member 90 has a shank 91, and a notch 911 is defined in the outside of the shank 91. The shank 91 extends through the third hole 81 of the rotary member 80, the first hole 51 of the center gear 50 and is inserted into the ratchet wheel 20. The bead 231 of the driving end 23 is accommodated in the notch 911 of the shank 91.

Figure 7:
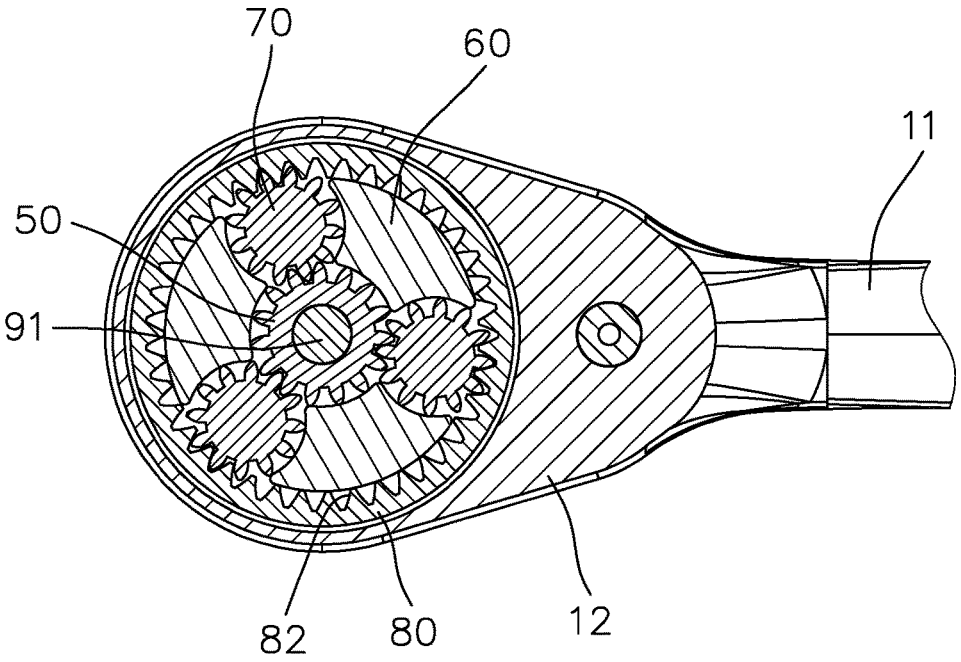
FIG. 7 is a cross sectional view to show that the three planet gears are engaged with the center gear in the ratchet wrench of the present invention.
Figure 8:
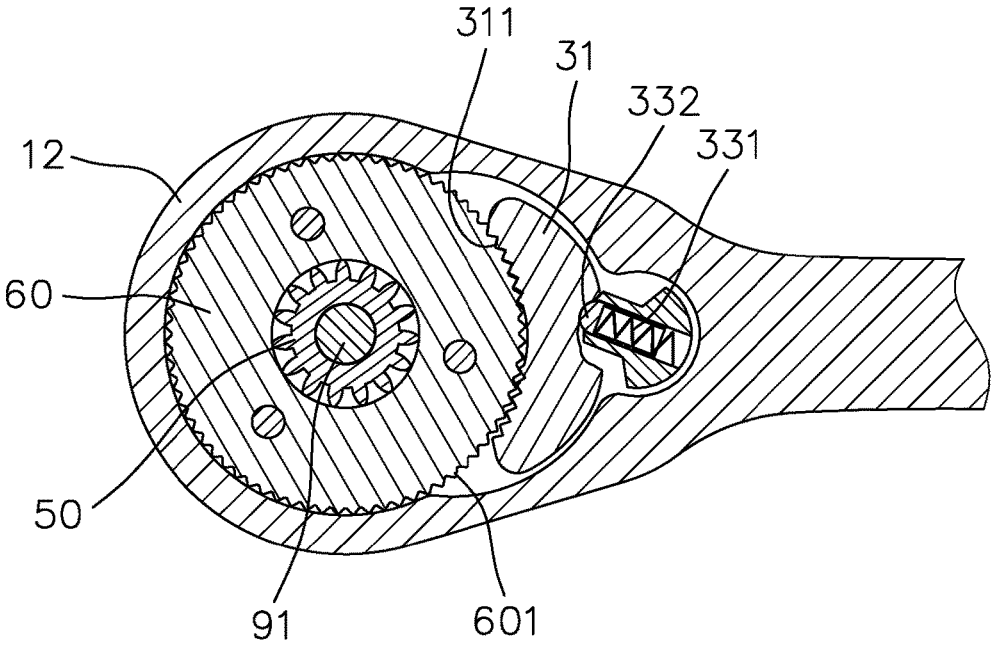
FIG. 8 is a cross sectional view to show that one of the pawls is engaged with the disk of the ratchet wrench of the present invention.
Figure 9:
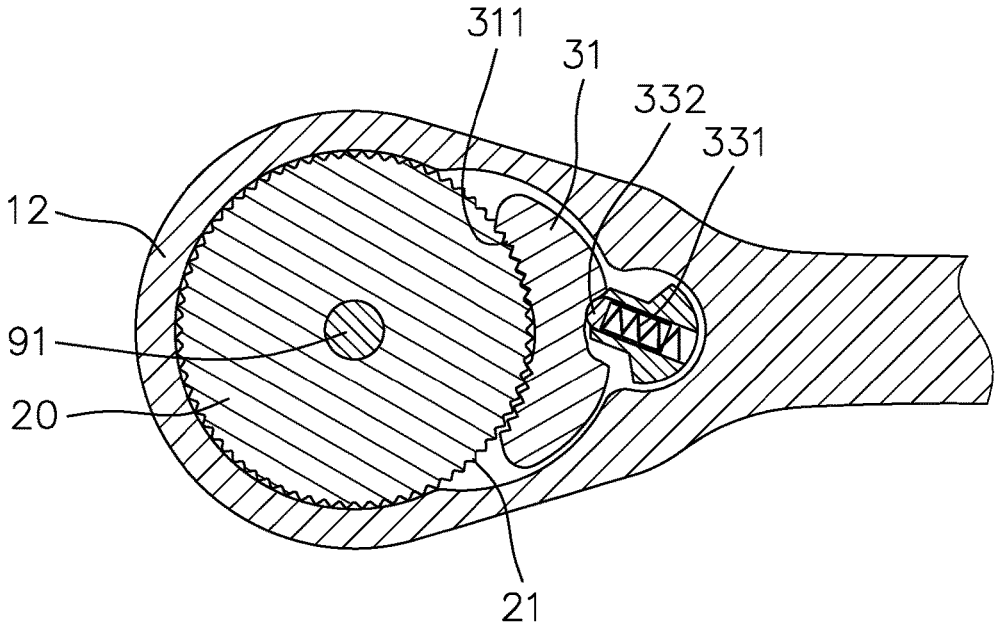
FIG. 9 is a cross sectional view to show that the other one of the pawls is engaged with the ratchet wheel of the ratchet wrench of the present invention.

When using the ratchet wrench 10, the driving end 23 is connected with a socket (not shown) so as to be engaged with a bolt (not shown). The two pawls 31 are engaged with the toothed portion 601 of the disk 60 and the ratchet teeth 21 of the ratchet wheel 20. When rotating the handle 11 of the ratchet wrench 10, the socket is rotated to loosen the bolt. The ratchet wrench 10 does not need to be rotated continuously, and the user rotates the rotary member 80 to drive the planet gears 70. The planet gears 70 rotates the center gear 50 as shown in FIG. 7, and the center gear 50 drives the ratchet wheel 20 at high speed, such that the bolt can be further loosened within a short period of time.

Alternatively, when tightening a bolt, the user first rotates the rotary member 80 to drive the planet gears 70. The planet gears 70 rotates the center gear 50, and the center gear 50 drives the ratchet wheel 20 at high speed, such that the bolt can be quickly inserted into the threaded hole within a short period of time. Then, the user rotates the handle 11 to further tighten the bolt. The ratchet wheel 20 can be rotated at three times of the speed of the conventional ratchet wrench by using the planet gears 70. The disk 60 positions the three planet gears 70 and the planet gears 70 are operated smoothly.

The use of the rotary member 80 can rotate the driving end 23 at high speed without rotating the handle 11 so as to efficiently rotate the object to be tightened or loosened.

While we have shown and described the embodiment in accordance with the present invention, it should be clear to those skilled in the art that further embodiments may be made without departing from the scope of the present invention.

What is claimed is:

1. A ratchet wrench comprising:

a handle and a head which is connected to one end of the handle, the head having a room defined therethrough;

a ratchet wheel rotatably received in the room and having ratchet teeth defined in an outside thereof, a first engaging portion defined in a top of the ratchet wheel, a driving end extending from a bottom of the ratchet wheel, a bead embedded in the driving end;

a switch unit having two pawls, a switch shaft and a contact portion, the two pawls and the switch shaft received in the room, each pawl having engaging teeth formed in a front side of two ends thereof, the engaging teeth on the two ends of one of the pawls selectively and respectively engaged with the ratchet teeth of the ratchet wheel, the switch shaft pivotably connected to the head, the contact portion connected to the switch shaft and contacting the two pawls;

a cover connected to the head and the driving end of the ratchet wheel extending through the cover;

a center gear having a first hole defined therethrough, a second engaging portion extending from a bottom of the center gear and engaged with the first engaging portion of the ratchet wheel;

a disk having a toothed portion defined in an outside thereof and connected to the top of the ratchet wheel, a second hole defined centrally therethrough and the center gear received in the second hole, three recesses defined in a top of the disk, the engaging teeth of the two ends of the other pawl selectively and respectively engaged with the toothed portion;

a planet gear unit having three planet gears which are respectively located in the three recesses of the disk, the center gear located between the three planet gears and engaged with the three planet gears;

a rotary member having a third hole defined centrally therethrough, the rotary member having a recessed area defined in a bottom thereof and inner teeth defined in an inner periphery of the recessed area, the rotary member mounted to the three planet gears which are engaged with the inner teeth, and a push member having a shank, a notch defined in an outside of the shank, the shank extending through the third hole of the rotary member, the first hole of the center gear and inserted into the ratchet wheel, the bead of the driving end accommodated in the notch of the shank.

2. The ratchet wrench as claimed in claim 1, wherein the contact portion includes two protrusions and two springs which respectively bias the two protrusions, the two protrusions respectively contact two respective rear sides of the two pawls.

3. The ratchet wrench as claimed in claim 1, wherein the second engaging portion of the center gear is a hexagonal protrusion, the first engaging portion of the ratchet wheel is a hexagonal recess.

* * * * *